US010094539B2

(12) United States Patent
Serwacki et al.

(10) Patent No.: US 10,094,539 B2
(45) Date of Patent: Oct. 9, 2018

(54) FIXTURE AND LED SYSTEM WITH SAME

(71) Applicant: MOLEX INCORPORATED, Lisle, IL (US)

(72) Inventors: Megan E. Serwacki, Oswego, IL (US); Gregory Kuchuris, Wheaton, IL (US); Daniel B. McGowan, Glen Ellyn, IL (US); Timothy Canzano, Glen Ellyn, IL (US); Christopher Blount, Naperville, IL (US); Victor Zaderej, Wheaton, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/120,904

(22) PCT Filed: Feb. 25, 2015

(86) PCT No.: PCT/US2015/017530

§ 371 (c)(1),
(2) Date: Aug. 23, 2016

(87) PCT Pub. No.: WO2015/130788

PCT Pub. Date: Sep. 3, 2015

(65) Prior Publication Data

US 2016/0363298 A1 Dec. 15, 2016

Related U.S. Application Data

(60) Provisional application No. 61/944,398, filed on Feb. 25, 2014.

(51) Int. Cl.

| | |
|---|---|
| ***F21V 17/10*** | (2006.01) |
| ***F21V 9/30*** | (2018.01) |
| ***F21V 21/096*** | (2006.01) |
| ***F21K 9/20*** | (2016.01) |
| ***F21V 29/74*** | (2015.01) |
| ***F21V 9/16*** | (2006.01) |
| ***F21V 15/01*** | (2006.01) |
| ***F21V 23/00*** | (2015.01) |

(Continued)

(52) U.S. Cl.

CPC ..... *F21V 17/105* (2013.01); *F21K 9/20* (2016.08); *F21V 9/16* (2013.01); *F21V 9/30* (2018.02); *F21V 15/01* (2013.01); *F21V 21/096* (2013.01); *F21V 23/005* (2013.01); *F21V 23/006* (2013.01); *F21V 23/02* (2013.01); *F21V 23/06* (2013.01); *F21V 29/74* (2015.01); *F21Y 2115/10* (2016.08)

(58) Field of Classification Search

CPC ..... F21V 17/105; F21V 29/74; F21V 15/01; F21V 21/096; F21V 23/005; F21V 23/006; F21V 23/02; F21V 23/06; F21K 9/20; F21K 9/16; F21Y 2115/10

See application file for complete search history.

(56) References Cited

U.S. PATENT DOCUMENTS

| | | | |
|---|---|---|---|
| 7,750,458 | B2 | 7/2010 | Takeda et al. |
| 8,414,178 | B2 | 4/2013 | Alexander et al. |

(Continued)

*Primary Examiner* — Mary Ellen Bowman

(74) *Attorney, Agent, or Firm* — Jeffrey K. Jacobs

(57) ABSTRACT

A LED system is disclosed that includes a fixture with a module mounted in the fixture. The fixture includes a bottom wall with a socket. The module mounts in the socket and is biased into a mated condition with two magnets. The socket includes pads that are engaged by terminals that are supported by the module. A power supply can be mounted on a back side of the fixture.

14 Claims, 15 Drawing Sheets

(51) Int. Cl.

| | |
|---|---|
| ***F21V 23/02*** | (2006.01) |
| ***F21V 23/06*** | (2006.01) |
| *F21Y 115/10* | (2016.01) |

(56) References Cited

U.S. PATENT DOCUMENTS

| | | | |
|---|---|---|---|
| 8,425,082 | B2 | 4/2013 | Wang |
| 9,163,811 | B2 | 10/2015 | Zaderej et al. |
| 9,739,457 | B2 | 8/2017 | Breen, IV et al. |
| 2009/0279298 | A1 | 11/2009 | Mier-Langner et al. |
| 2013/0044501 | A1 | 2/2013 | Rudisill et al. |
| 2013/0141918 | A1 | 6/2013 | Harbers et al. |
| 2013/0308324 | A1 | 11/2013 | Zaderej et al. |

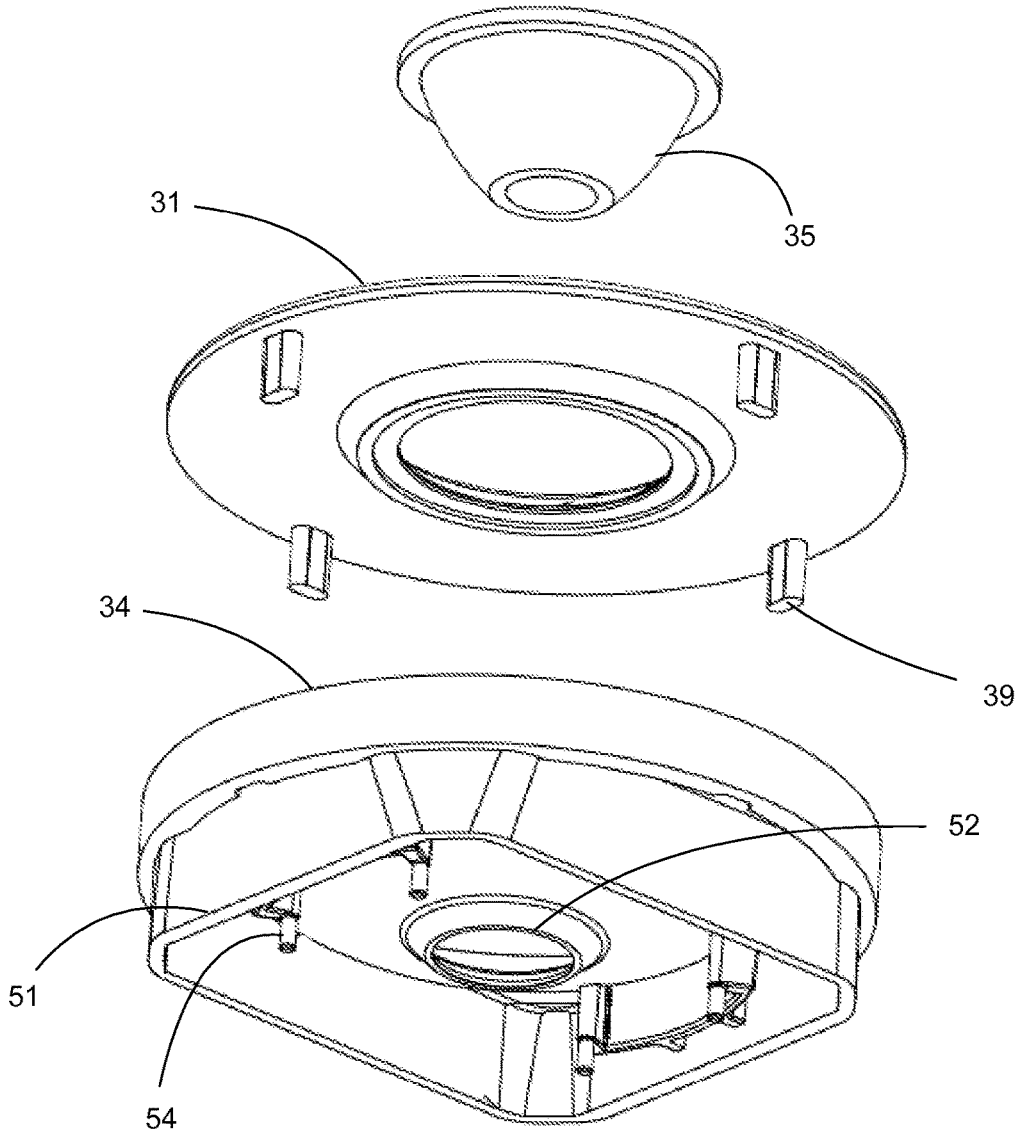
Fig. 15
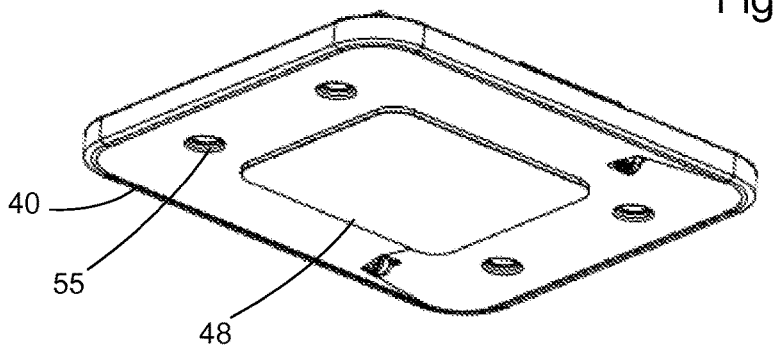

FIXTURE AND LED SYSTEM WITH SAME

RELATED APPLICATIONS

This application claims priority to U.S. Provisional Appln. No. 61/944,398, filed Feb. 25, 2014, which is incorporated herein by reference in its entirety.

TECHNICAL FIELD

This disclosure relates to field of illumination with a light emitting diode (LED).

DESCRIPTION OF RELATED ART

LED related designs are known. Typical designs have one of two configurations. One configuration provides for an LED that screws directly into an Edison based socket (what is often referred to as a replacement bulb). As can be appreciated, such designs have to include AC to DC power conversion circuitry and an LED into a compact package that somehow must cool 7-13 watts. As they must compete with other designs, such as compact fluorescent bulbs, cost is a significant issue and therefore the designs tend to be mediocre in performance (neither offering great optics, great color or great efficiency). In addition, the replacement bulbs tend to have problems with conversion of AC to DC and as a result, often emit substantial RF interference.

Other designs have an integrated solution where the LED is part of the picture and they have no readily replaceable components. Such systems can provide superior performance but there is no easy way to replace the LED if it fades over time (which is expected as most LEDs have a LM70 that is about or less than 50,000 hours). Thus, such designs tend to require removal and reinstallation of the entire fixture.

One alternative to the above design was the design based on U.S. application Ser. No. 13/498,044, filed Mar. 23, 2012 and which is incorporated herein by reference in its entirety. Such a design allows for a separable interface but due to the need to rotate the housing of the model, it is more difficult to provide a smaller sized can that can allow the module to be easy inserted and removed while still providing suitable thermal performance. Consequentially, further improvements in an LED system would be appreciated by certain individuals.

SUMMARY

A light emitting diode (LED) system includes a fixture with a socket and a module that can be inserted into the fixture and that mates with the socket. The module can be secured to the socket with magnets and can be sized so as to provide a compact and desirable sized fixture while providing substantial amounts of lumens. The fixture can provide an AC to DC power conversion unit that allows for efficient operation and ensures that the interface is touch-safe.

BRIEF DESCRIPTION OF THE DRAWINGS

The present invention is illustrated by way of example and not limited in the accompanying figures in which like reference numerals indicate similar elements and in which:

FIG. 15 is another perspective view of the embodiment depicted in FIG. 14.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
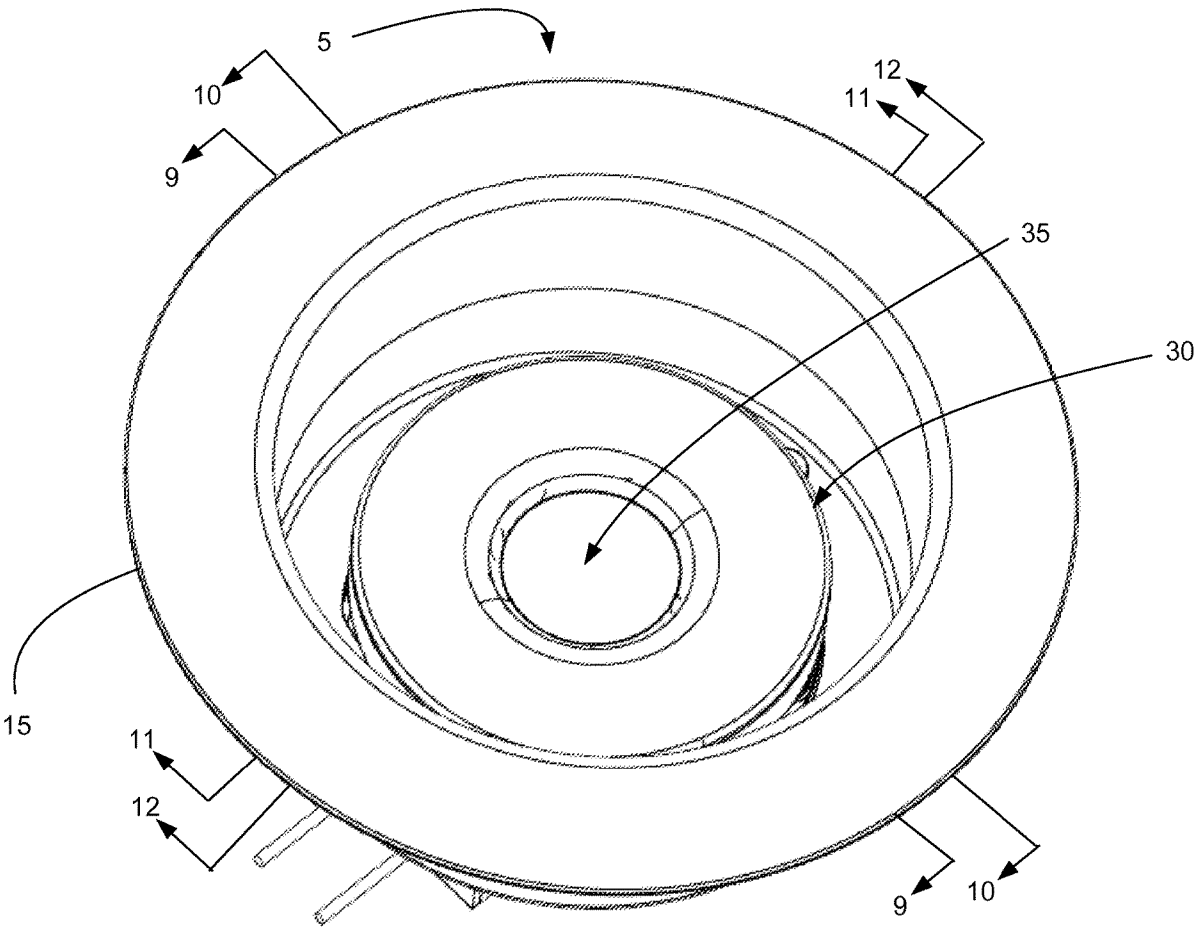
FIG. 1 is a perspective view of an embodiment of a light emitting diode (LED) fixture with a module installed.
Figure 2:
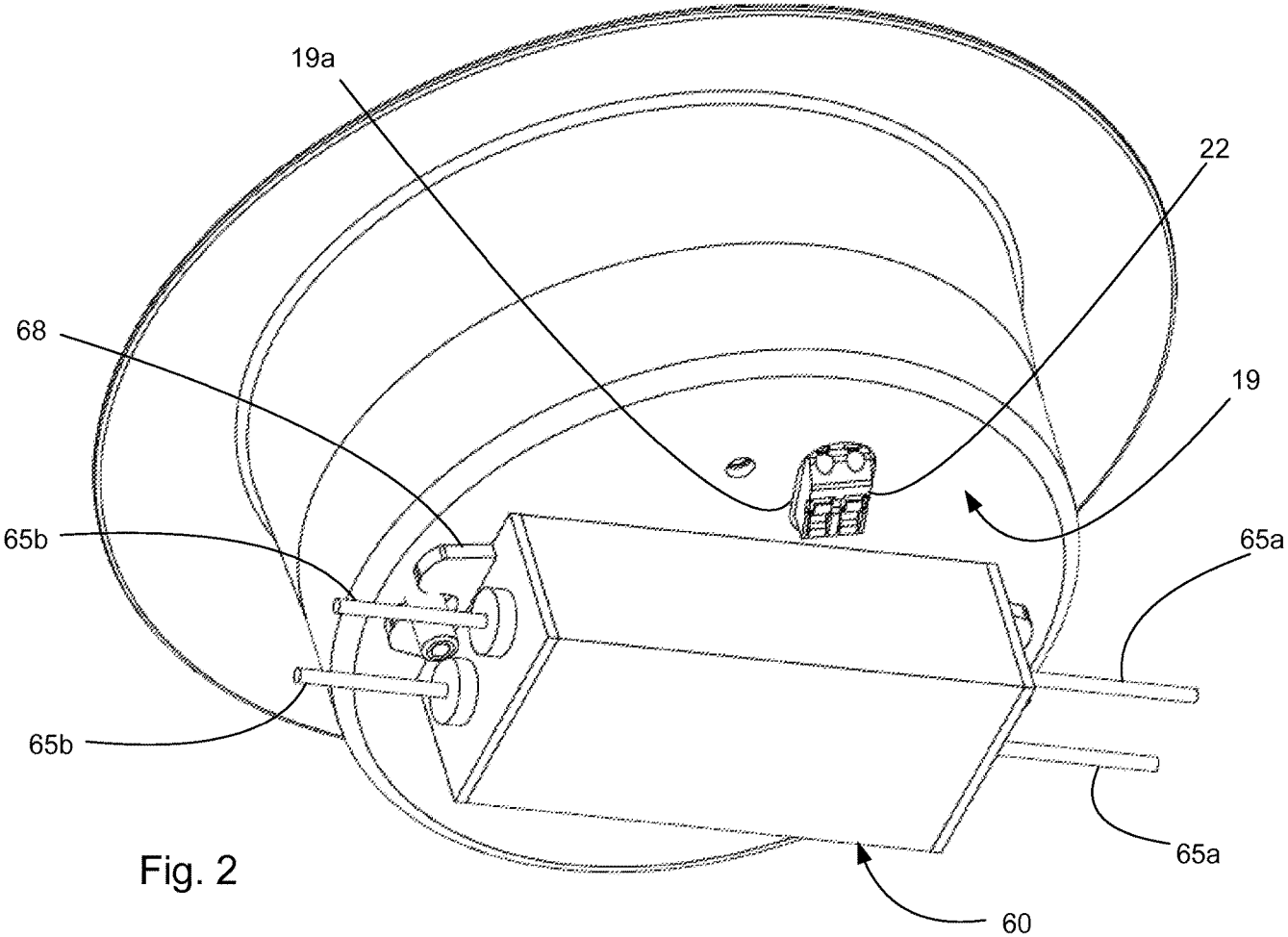
FIG. 2 is another perspective view of the embodiment depicted in FIG. 1.
Figure 3:
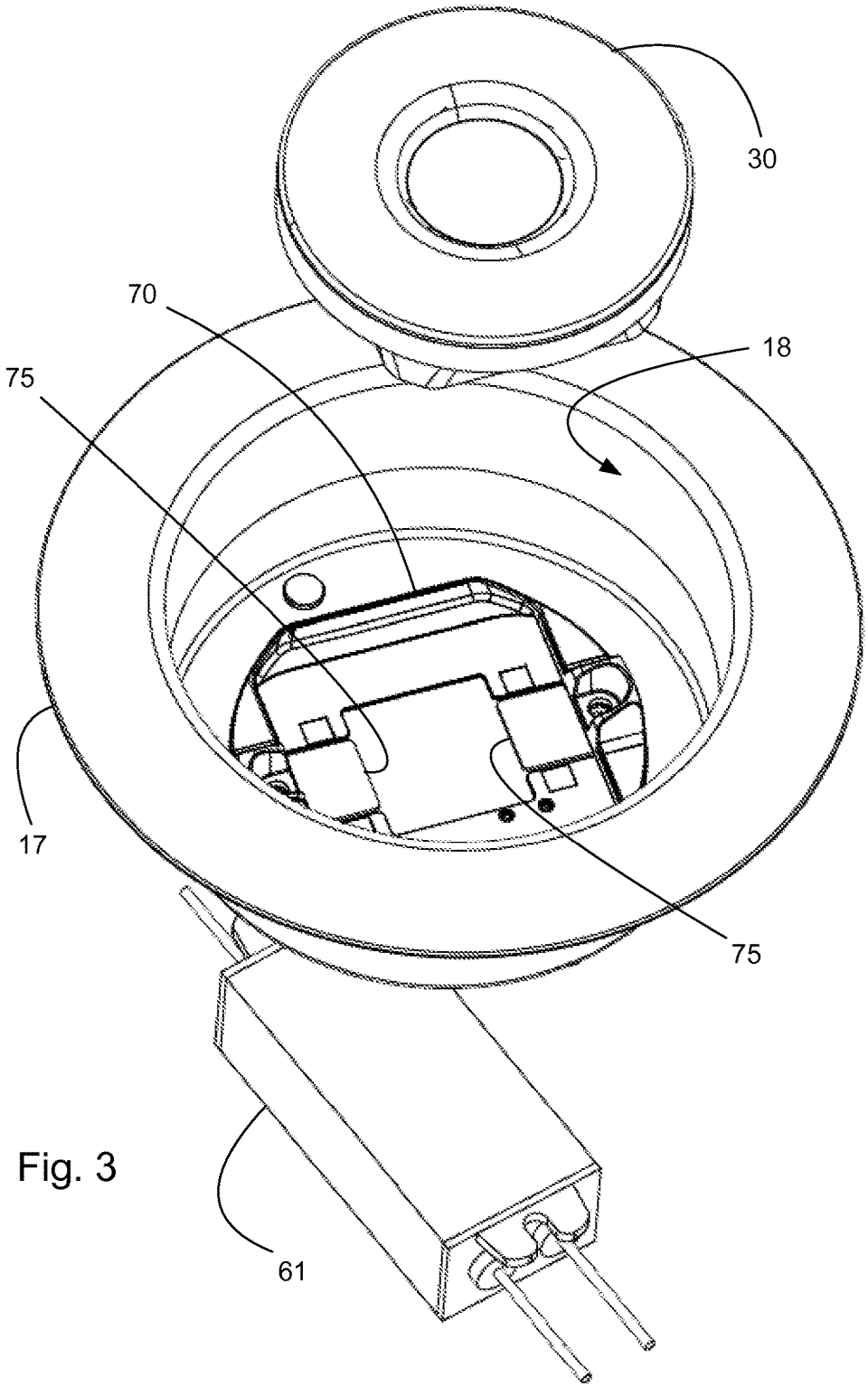
FIG. 3 is a perspective exploded view of an embodiment of a LED fixture.
Figure 4:
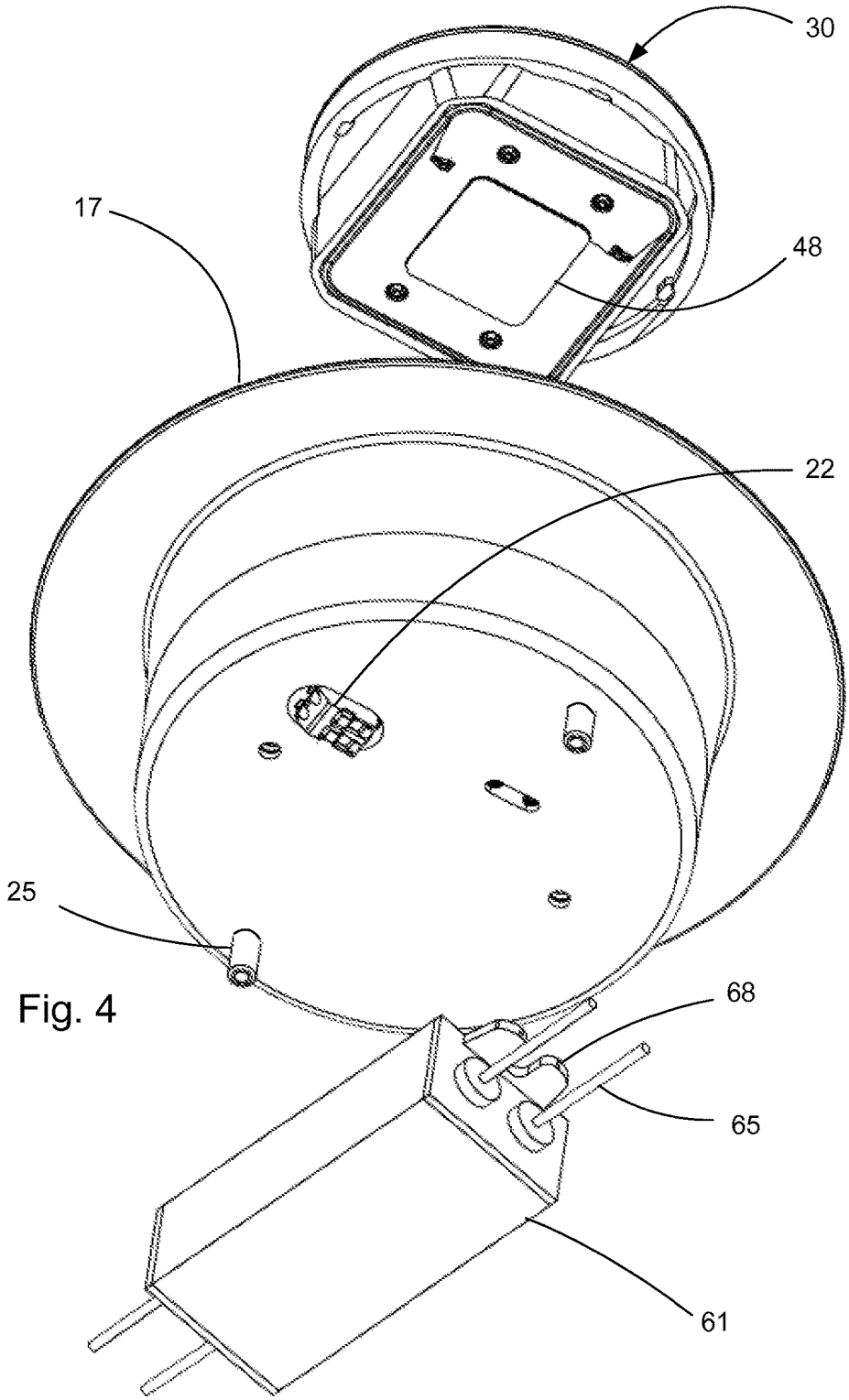
FIG. 4 is another perspective view of the embodiment depicted in FIG. 3.
Figure 5:
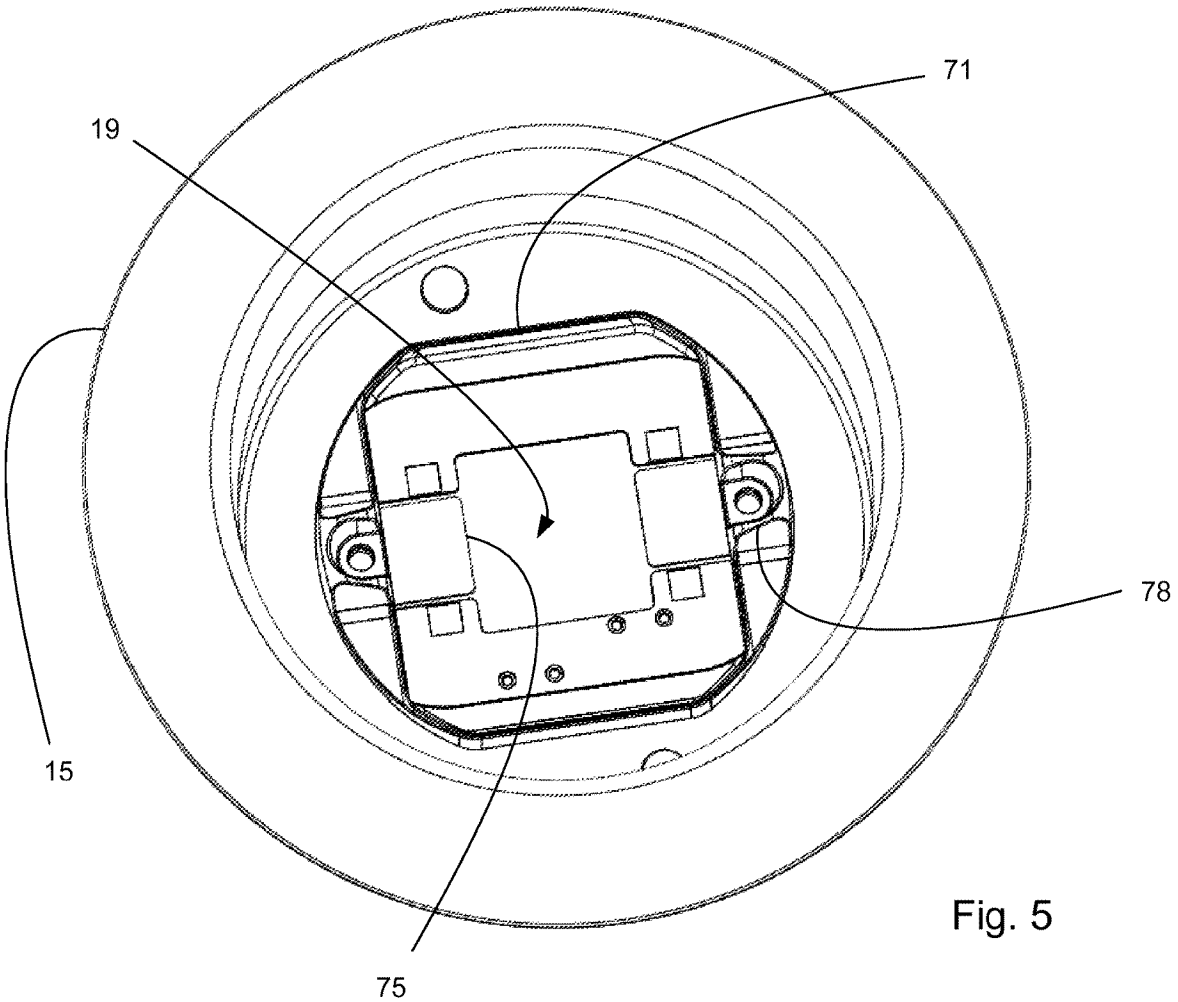
FIG. 5 is a perspective view of an embodiment of a fixture and socket.
Figure 6:
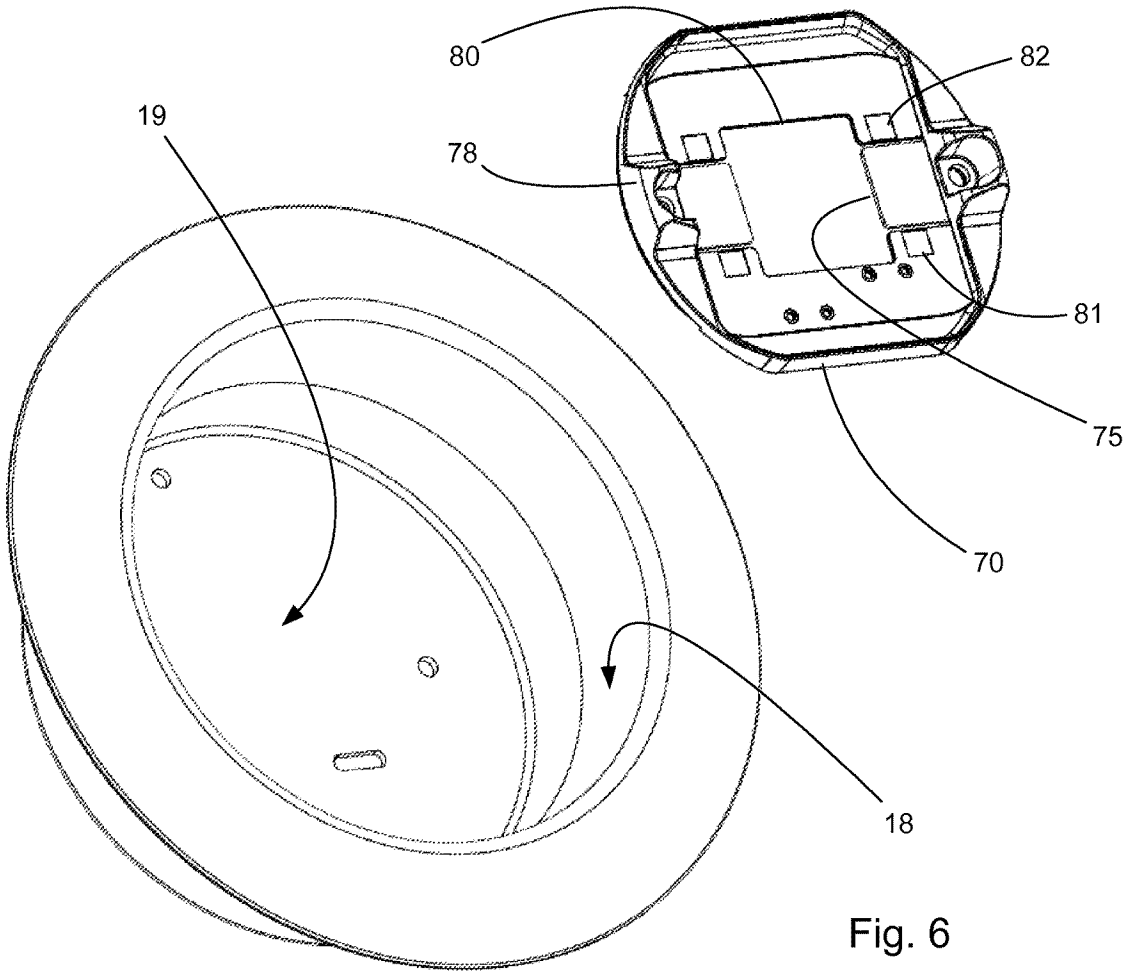
FIG. 6 is a partially exploded perspective view of the embodiment depicted in FIG. 5.
Figure 7:
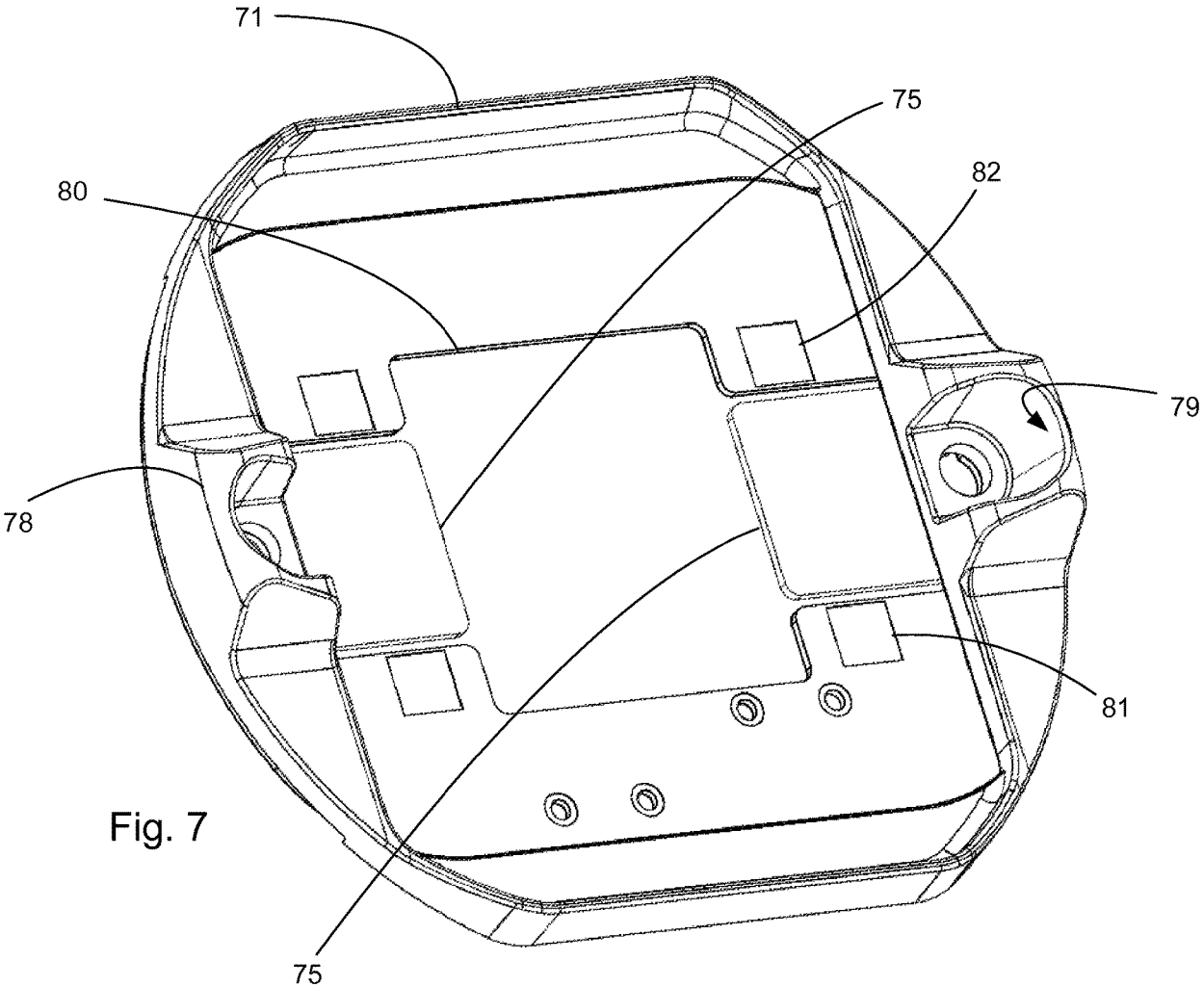
FIG. 7 is a perspective view of an embodiment of a socket.
Figure 8:
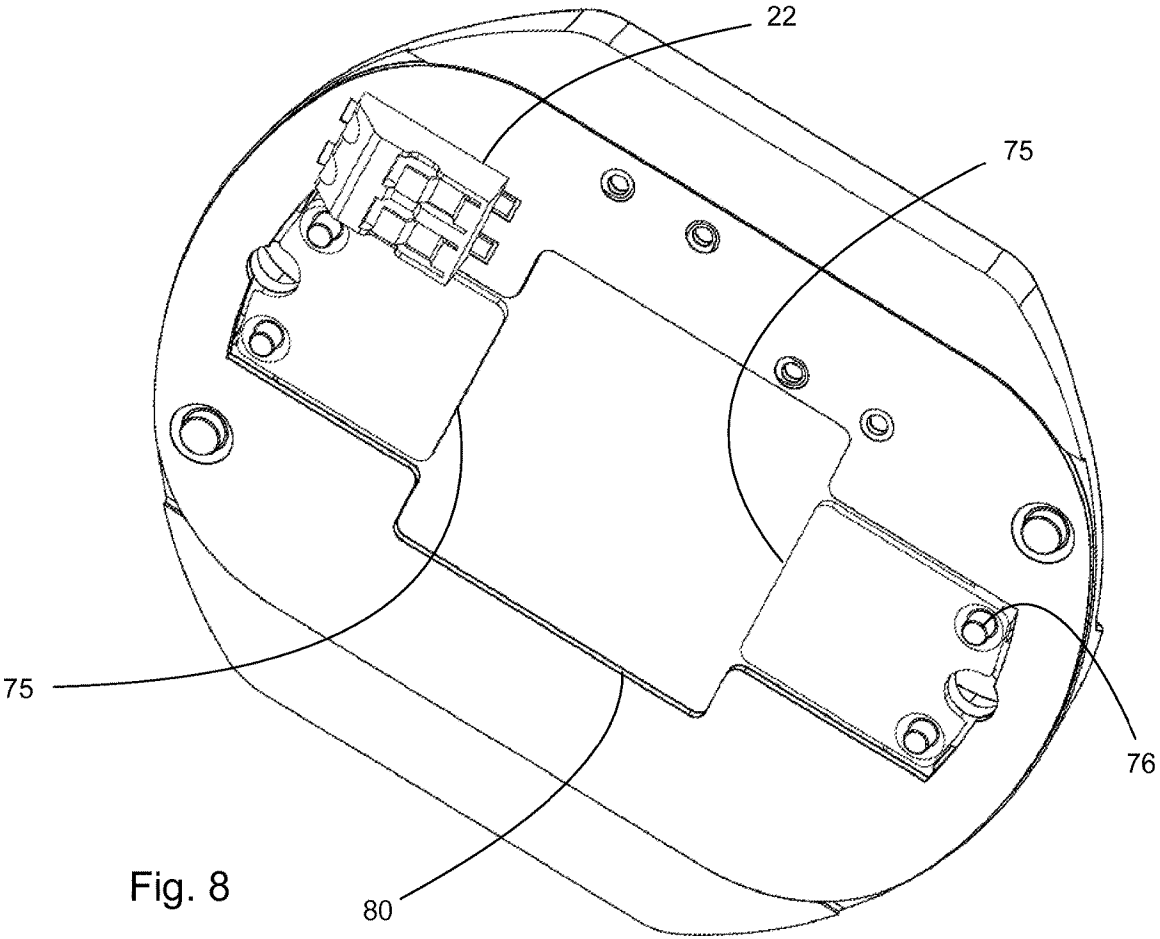
FIG. 8 is another perspective view of the embodiment depicted in FIG. 7.
Figure 9:
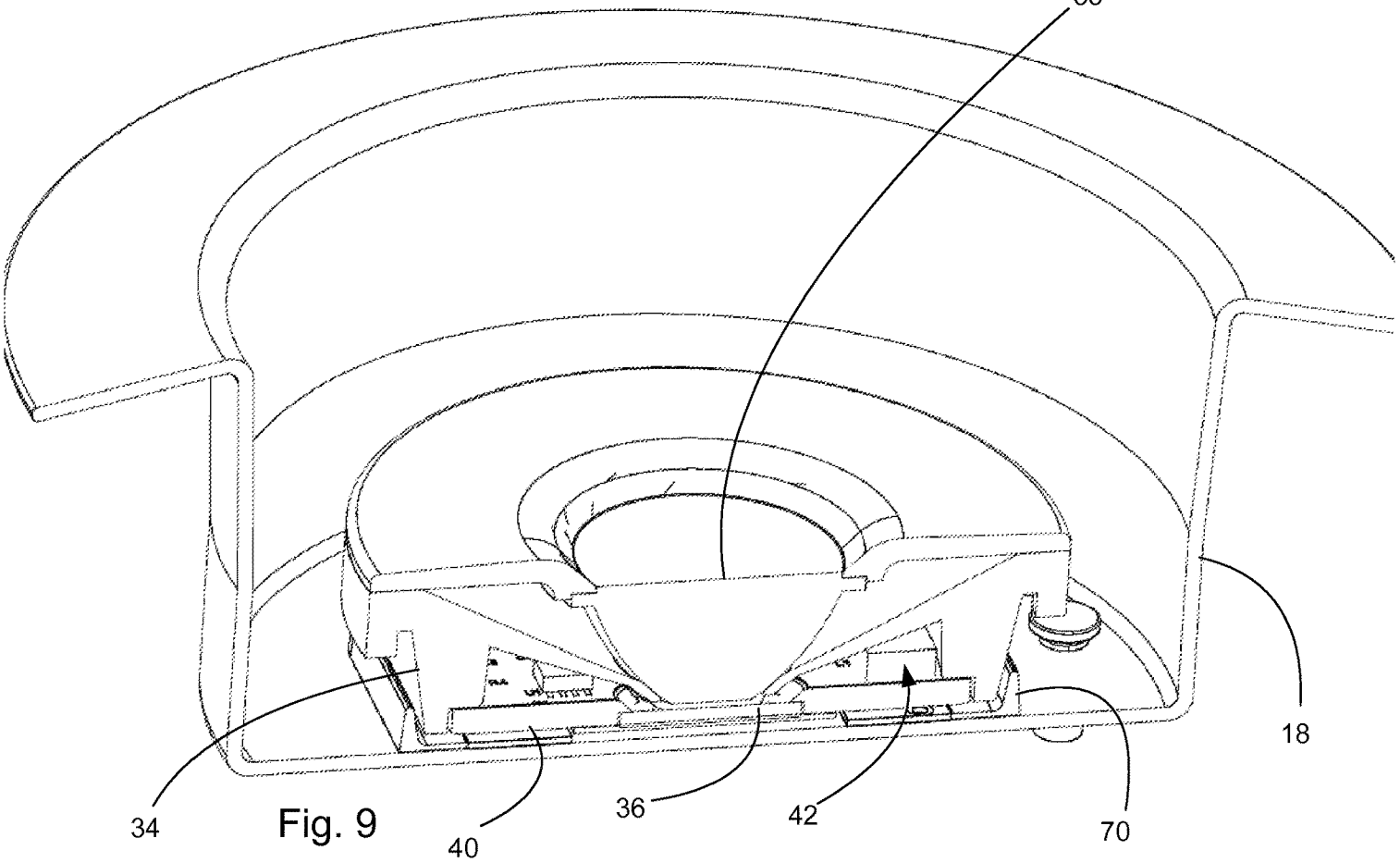
FIG. 9 is a perspective cross-sectional view taken along line 9-9 in FIG. 1.
Figure 10:
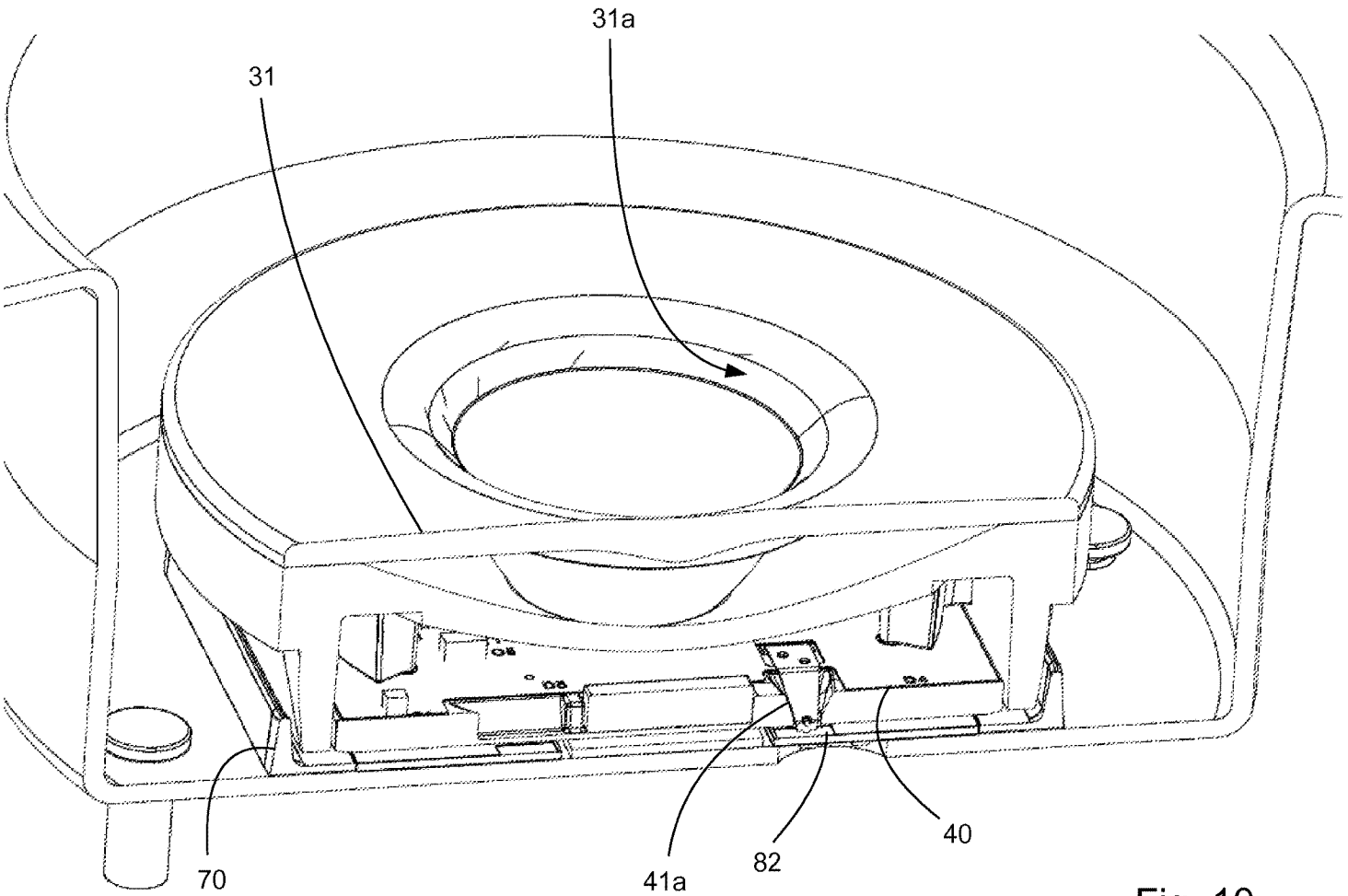
FIG. 10 is a perspective cross sectional view taken along line 10-10 in FIG. 1.
Figure 11:
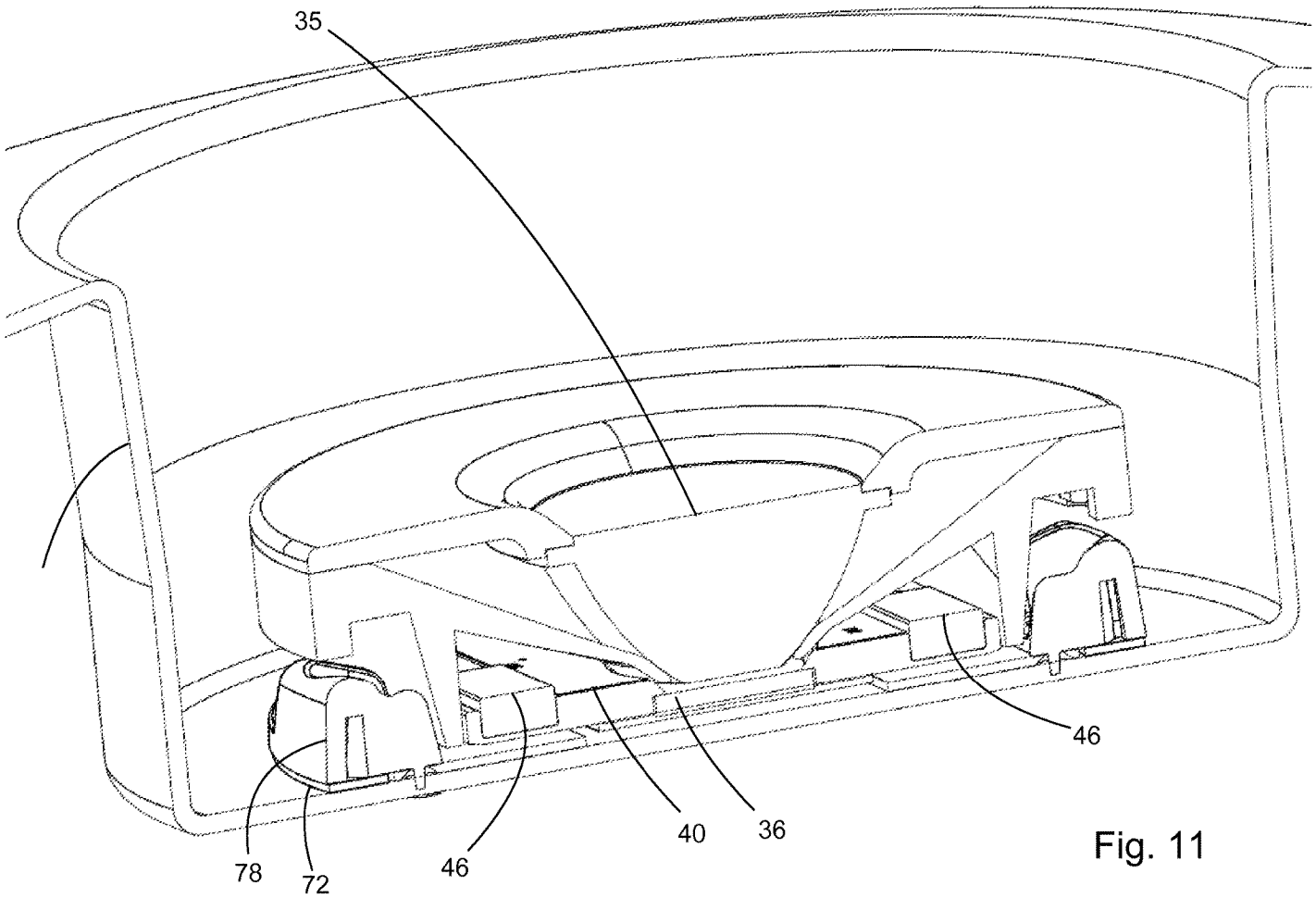
FIG. 11 is a perspective cross sectional view taken along line 11-11 in FIG. 1.
Figure 12:
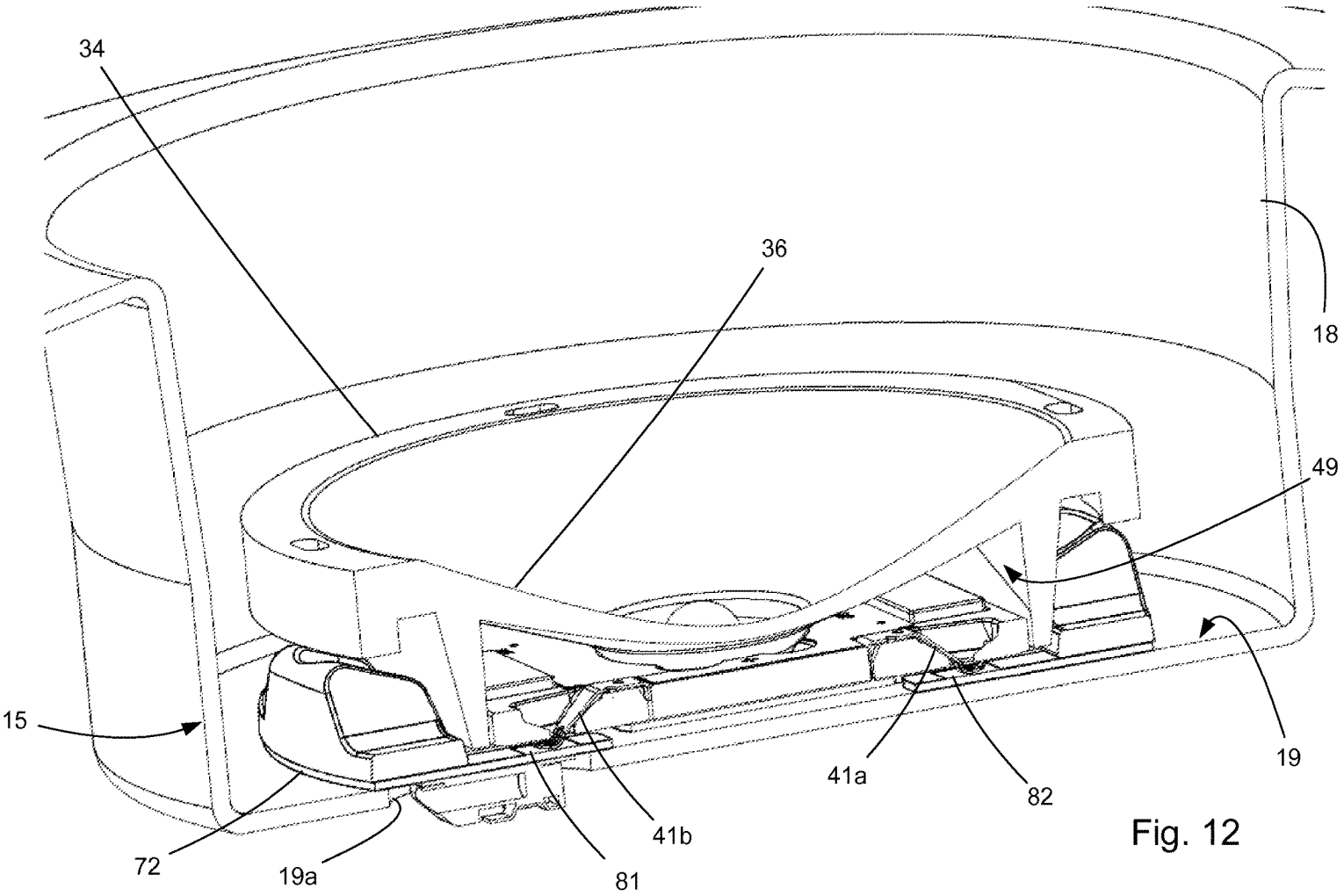
FIG. 12 is a perspective simplified cross sectional view taken along line 12-12 in FIG. 1.
Figure 13:
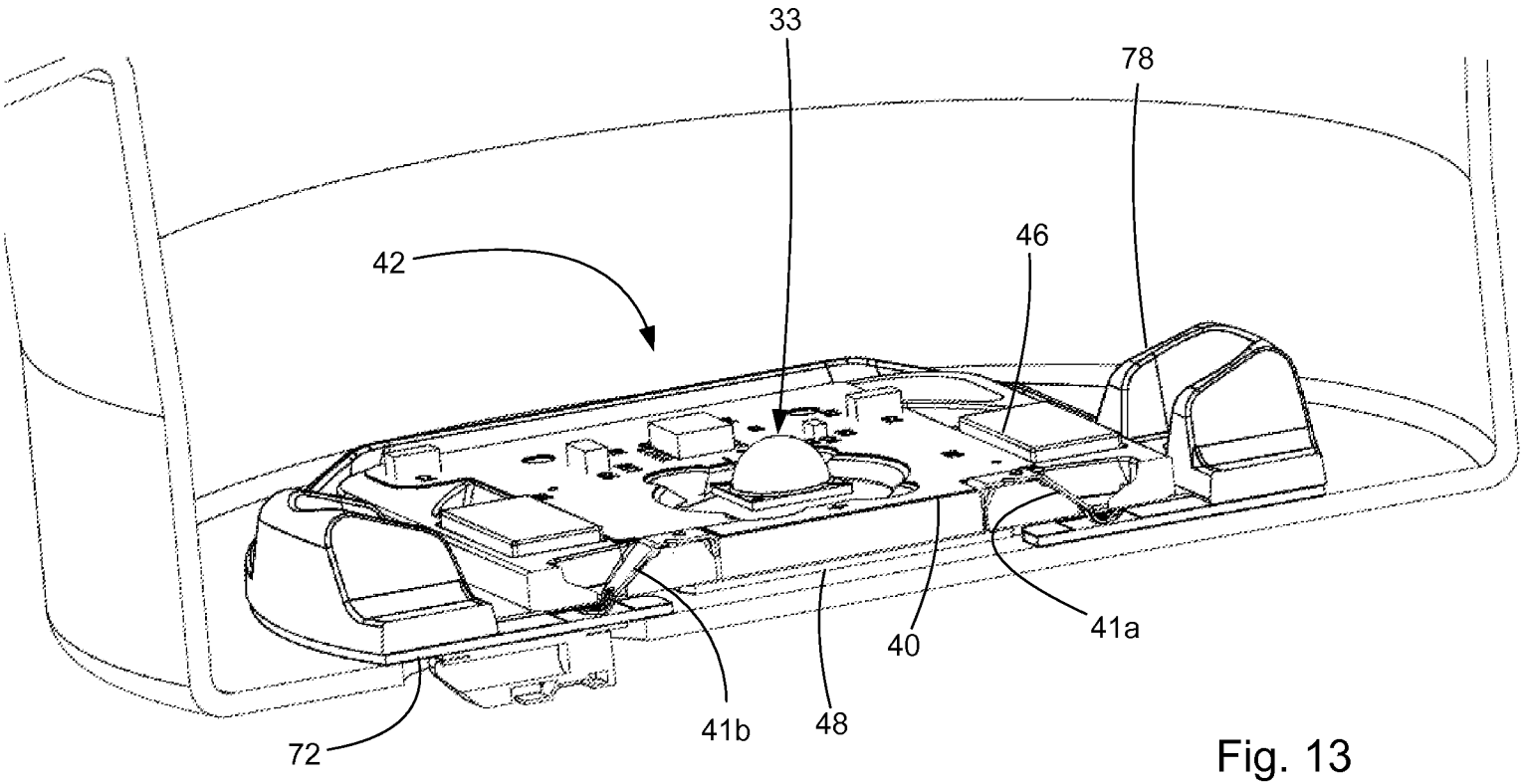
FIG. 13 is a perspective partial view of the embodiment depicted in FIG. 12.
Figure 14:
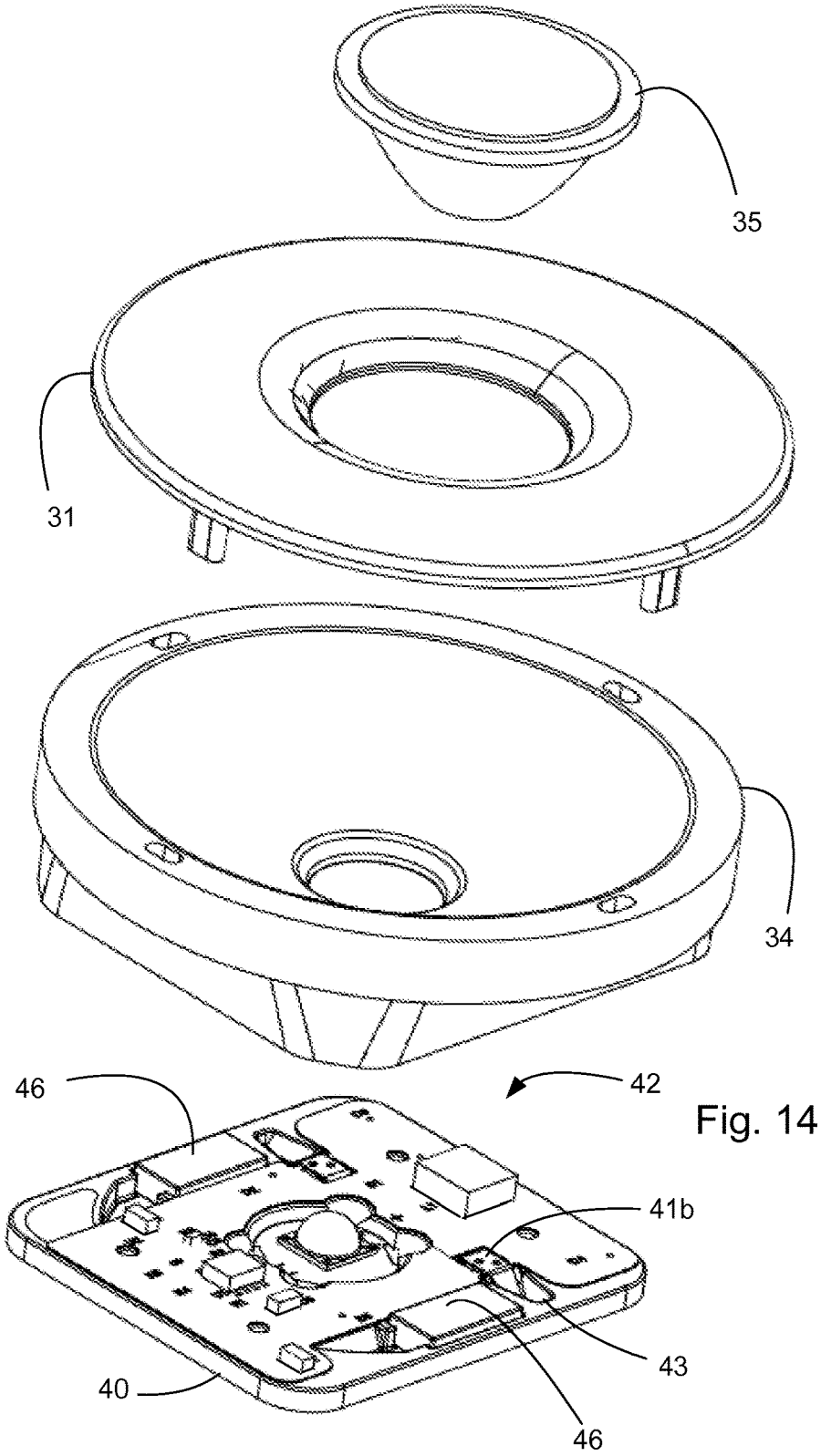
FIG. 14 is a perspective exploded view of an embodiment of a module.

FIGS. 1-15 illustrate a plurality of features that can be used to provide a light emitting diode (LED) system 5. The LED system 5 includes a fixture 15 with a shell 16, a socket 70 mounted to the shell 16 and a module 30 that mounts into the socket 70 and is secured in the socket 70 by one or more magnets 46. It should be noted that the module 30 can be sized so that it is 50 mm in diameter, thus the depicted design can provide a compact and useful system while emitting more than 500 lumens (preferably more than 600 lumens). In an embodiment, for example, the system can emit about 700 to 800 lumens and thus be a downlight replacement.

The depicted shell 16 includes a side wall 18 and a bottom wall 19 on which the socket 70 is mounted (the socket is mounted on a first side of the bottom wall). The fixture may also include an optional flange 17 if desired. The fixture includes a power aperture 19*a* that allows a connector 22 to extend therethrough.

A power supply 60 can be mounted to the shell 16 and in the depicted embodiment studs 25 extend out from the bottom wall 19 and the power supply 60 includes a bracket 68 that is secured to the studs 25. Thus, as depicted, the power supply 60 is mounted on a second side of the bottom wall 19. Naturally the power supply 60 could also be mounted in other locations. Wires 65*a* provide power to the power supply 60 and wires 65*b* provide power to the connector 22 (which in turn powers the module 30). In an embodiment the connector 22 can be a poke-in connector as this allows for substantial flexibility in the installation process but in other embodiments the connector 22 could be configured to engage a mating connector of a desirable configuration. As can be appreciated, the power supply can include an AC to DC conversion so that DC power can be readily provided to the socket 70.

In addition, if multiple fixtures are being located in an adjacent area then a single AC to DC converter could be provided that supports all the adjacent fixtures and a power cable could extend from the power supply 60 to each fixture. As each module is expected to only require 10+/−5 watts of energy, it is expected that even a small power supply could readily handle 5 or 6 fixtures simultaneously. Thus, the system provides for substantial flexibility and the potential for cost effective solutions.

The socket 70 includes a frame 71 that supports ferrite plates 75 that are used to attract a magnet and this design is generally beneficial as it allows for more flexibility in the material choices of the fixture. However, in embodiments where the fixture is ferrite-based material the ferrite plates 75 can be omitted. The frame 71 includes projections 78 that can be used to help provide orientation for the corresponding module 30 and the projections can also include a well 79 that provides access/clearance to a fastener (not shown) that can be used to secure the socket 70 to the shell 16. The socket 70 includes a thermal aperture 80 that allows a mating module to directly engage the shell 16 so as to provide for more efficient thermal transfer of energy from the module 30 to the shell 16 (it being understood that the shell 16 can act as a heat sink for the module 30). Naturally, the size of the shell 16 will limit the amount of thermal energy that can be reliably dissipated and thus will limit the amount of power that can be consumed by the module. The depicted fixture is expected to readily manage 10-12 watts and thus is expected to allow for downlights that can provide 800 to 1000 lumens or more (depending on the efficiency of the module). If further thermal energy transfer is required then the shell 16 can incorporate fins to increase the surface area (and thus improve the thermal handling capabilities).

The socket 70 also supports pads 81, 82 that are configured to act as an anode or cathode for the module. Depending on the design of the module, it may be necessary to control the orientation of the module 30 with respect to the socket 70 so that the power is applied with the appropriate polarity. Alternatively, the socket 70 could be configured so it could accept the module in two orientations and could be wired so that the same polarity was presented to the module regardless of which orientation the module was inserted into the socket. Alternatively the module 30 could include a rectifier so that the polarity did not impact the module 30.

The ferrite plates 75 can be attached to the socket 70 with heat stakes 76. In addition, the connector 22 can be soldered to the traces and/or terminals provided in the socket 70, which in turn are electrically connected to the pads 81, 82 so that the connector 22 is electrically connected to the pads 81, 82.

The module 30 includes a base 40 that supports turn supports a light emitting diode (LED) array 33 that includes a substrate 36 that supports LED chips. The LED array 33 can include a covering to protect the LED chips that make up the LED array 33 and may also include a phosphor layer to convert light emitted from the LED chips from one wavelength to another wavelength.

The base 40 also supports circuitry 42, which can include conventional electrical components and traces that connect the components together, as well as controllers and rectifiers and any other desired components. In an embodiment the circuitry can include a driver that allows the LED array to operate at the desired illumination level and can provide for dimming without flickering. The base 40 also supports terminals 41*a*, 41*b* that extend into terminal apertures 43 and engage the pads 81, 82 when the module 30 is inserted into the socket 70. In operation, the magnets 46 bias the module 30 against the socket 70 so that the terminals 41*a*, 41*b* deflect and thus helps provide a reliable connection between the module 30 and the socket 70.

As can be appreciated, the socket 70 includes a bottom layer 72 that supports the pads 81, 82 on one side and the connector 22 on the other side. In an embodiment the bottom layer 72 can include traces to connect the pads 81, 82 to the connector 22. Preferably the bottom layer 72 will just be integral with the frame 71. In operation the pads can be connected to the power supply so that they have a DC voltage. The power supply can be configured to provide a low enough voltage so that the pads 81, 82 can be considered touch-safe and in an embodiment can be at 10-30 volts. Thus the LED system can be configured to provide a socket that is considered touch-safe.

The module 30 includes an optional lens 35 that can reflect and/or shape light emitted from the LED array 33. The module also includes a housing 34 that couples to the base 40 and provides an internal pocket 49 that provides space for the circuitry 42 that is mounted on the base 40. The housing 34 includes a wall 54 that helps define the size of the internal pocket 49 and the housing 34 also includes fingers 54 that are configured to secure the housing 34 to the base 40 and the fingers 54 can be inserted into finger apertures 55 and heat staked into place.

To improve thermal performance, the base 40 supports the substrate 36 and a thermal pad 48 is positioned on the substrate 36 and in operation the magnets 46 cause the thermal pad 48 to be compressed against the bottom wall 19 when the module 30 is installed in the socket 70. This allows sufficient pressure so as to enable a relatively high thermal conductivity between the substrate 35 and the bottom wall 19.

As can be appreciated, therefore, the depicted design allows the LED array 33 supported by the module 30 to be thermally coupled to the shell 16 (which acts as a heat sink) with just two thermal junctions. One thermal junction is between the substrate 36 and a thermal pad 48 and the other thermal junction is between the thermal pad 48 and the shell 16. The depicted design thus allows for a highly efficient thermal interface while being secured into place by the use of two magnets that are provided in the module.

As can be appreciated, the depicted design allows for vertical translation of the module 30 into the socket 70, thus the thermal pad 48 can be formed of a wide range of materials and does not need to provide for low sliding friction (e.g., the thermal pad can be tacky). In addition, as the terminals 41*a*, 41*b* deflect they can translate horizontally to some amount and therefore the deflection helps provide some wipe so that a more reliable electrical connection is provided in spite of the simple vertical translation.

It should be noted that while the depicted fixture is shaped similar to a downlight, and the module 30 includes the cover 31 that has a curved surface 31*a* to allow for desirable optical performance. The module can include a rectangular shaped base to allow for orientation control. Naturally, however, other configurations are contemplated. For example, the socket could be mounted on a flat plate (so as to provide a suitable construction for an under cabinet lighting system) or in a pendant. In such a system the size of the module could be further reduced to a size of about 35 mm in diameter. As can be appreciated, such a small size might have a wider beam angle (the current design can be configured to provide a beam angle of less than 40 degrees) and might be configured to provide less lumens (if so desired).

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A light emitting diode (LED) system, comprising:

a fixture configured to be supported, the fixture including a shell with a bottom wall;

a socket mounted on the bottom wall; and a module positioned in the socket, the module including a base that supports two magnets and an LED array with a substrate, the substrate supported by the base, the module including a thermal pad, wherein the module is biased by the magnets toward the bottom wall so that the thermal pad is compressed between the substrate and the bottom wall.

2. The LED system of claim 1, wherein the fixture includes a power supply mounted to the fixture.

3. The LED system of claim 2, wherein the module includes a connector that extends through a power aperture in the bottom wall.

4. The LED system of claim 3, wherein the connector is a poke-in connector.

5. The LED system of claim 1, wherein the socket includes two ferrite plates.

6. The LED system of claim 5, wherein the socket includes two pads and the module includes two terminals, the terminals configured to deflect as they engage the pads when the module is positioned in the socket.

7. The LED system of claim 6, wherein the two pads are exposed.

8. The LED system of claim 7, wherein each one of the two pads are positioned on opposite sides of one of the ferrite plates.

9. The LED system of claim 1, wherein the socket includes a thermal aperture and the thermal pad is positioned in the thermal aperture.

10. The LED system of claim 6, wherein the socket includes projections on two opposing sides.

11. The LED system of claim 10, wherein the module has a rectangular base and the socket is configured to receive a rectangular shaped base.

12. A fixture, comprising:

a shell with a bottom wall that includes a power aperture;

a socket positioned on a first side of the bottom wall, the socket including a frame that supports a first ferrite plate and a second ferrite plate, the first and second ferrite plates positioned on opposite sides of the socket, a first pad positioned on one side of the first ferrite plate and a second pad positioned on an opposite side of the first ferrite plate; and a connector supported by the socket and electrically connected to the first and second pads, the connector extending through the power aperture.

13. The fixture of claim 12, wherein the fixture further includes a power supply mounted on a second side of the bottom wall.

14. The fixture of claim 13, wherein two wires couple the power supply to the connector, the connector being a wire poke-in type connector.

* * * * *